United States Patent [19]

Bridges

[11] 4,357,505

[45] Nov. 2, 1982

[54] POWER DRIVEN GROUP OPERATED CIRCUIT DISCONNECT APPARATUS FOR OVERHEAD ELECTRIC POWER LINE

[76] Inventor: Ronald P. Bridges, Heber Springs, Ark. 72543

[21] Appl. No.: 253,645

[22] Filed: Apr. 13, 1981

Related U.S. Application Data

[63] Continuation of Ser. No. 74,127, Sep. 10, 1979, abandoned.

[51] Int. Cl.[3] ..... H01H 3/26

[52] U.S. Cl. ..... 200/48 KB; 335/68; 335/69

[58] Field of Search ..... 74/25, 99; 335/68, 69, 335/71; 200/48 R, 48 KB, 49

[56] References Cited

U.S. PATENT DOCUMENTS

| | | | |
|---|---|---|---|
| 1,902,266 | 3/1933 | Ripp | 74/99 |
| 2,669,622 | 2/1954 | Owens | 200/48 R |
| 2,870,288 | 1/1959 | Schmidt | 335/69 |
| 2,954,754 | 10/1960 | Flick | 74/99 |
| 3,026,396 | 3/1962 | Fisher | 200/162 |
| 3,296,565 | 1/1967 | Kiesel | 335/69 |
| 3,508,179 | 4/1970 | Bernatt et al. | 335/68 |
| 3,559,121 | 1/1971 | Powell et al. | 335/68 |
| 4,095,061 | 6/1978 | Bridges | 200/48 KB |

OTHER PUBLICATIONS

Product Engineering–1953 Annual Handbook Dec. 1953, p. F 11.

*Primary Examiner*—John W. Shepperd

*Attorney, Agent, or Firm*—Wegner, McCord, Wood & Dalton

[57] ABSTRACT

A group operated circuit disconnect apparatus for overhead electric power lines has a base in the form of a box-like housing which mounts on a pole, an upright shaft extends through the housing, and a transverse shaft also extends through the housing. A linkage is mounted on the shafts in the housing so that axial rotation of the transverse shaft axially rotates the upright shaft, and this causes three circuit disconnect switches mounted on the housing to be moved simultaneously between closed positions and open positions, or vice versa. An electric motor driven screw and nut drive subassembly for the transverse shaft is mounted in the housing; and the ends of the housing have removable closure plates for access to the linkage and for removal of the subassembly.

27 Claims, 4 Drawing Figures

POWER DRIVEN GROUP OPERATED CIRCUIT DISCONNECT APPARATUS FOR OVERHEAD ELECTRIC POWER LINE

This is a continuation of application Ser. No. 74,127 filed Sept. 10, 1979, now abandoned.

BACKGROUND OF THE INVENTION

Overhead electric power distribution lines require circuit disconnect means at certain locations; and since such distribution lines commonly operate in a three-phase system, there are three associated lines which ordinarily must be disconnected and reconnected simultaneously. This requires group operated switches, and for safety and convenience during servicing of the lines, it is desirable that a person be able to open and close the circuit disconnect means on the overhead lines from ground level or from a remote central terminal.

The present invention is a power driven version of the group operated circuit disconnect apparatus of my U.S. Pat. No. 4,095,061.

There are power operated oil break units for remote switching of electric power transmission lines. The purpose of such units is generally to isolate a fault such as a short circuit. They are dangerous for a person working on the lines because the switches are concealed from view so there is no visual indication of whether they are open or closed.

In general, prior art power driven circuit disconnect apparatus which can be controlled either from the ground or from a remote central terminal has been mechanically very complex and has also been expensive.

SUMMARY OF THE INVENTION

The principal object of the present invention is to provide an improved power driven group operated circuit disconnect apparatus for three-phase overhead electric power lines; and one which is far less expensive than anything in the prior art.

Another object of the invention is to provide such an apparatus in which the power drive and the switch operating mechanism are all in a weather proof box-like housing which mounts on top of a pole and serves as a base for the three switches.

Still another object of the invention is to provide a power driven group operated, circuit disconnect apparatus which may be completely adjusted in the manufacturer's plant and mounted without field adjustment.

Still another object of the invention is to provide a group operated circuit disconnect apparatus in which driving force from an electric motor rotates one shaft by means of a simple screw and nut drive, with power from that shaft being transmitted to another shaft through a very simple mechanical driving connection so that all three switches are opened and closed simultaneously.

Yet another object of the invention is to provide an apparatus which can utilize either a battery operated D. C., motor or a 120 v. A.C. motor.

A further object of the invention is to provide an apparatus which has a power subassembly that can be easily disconnected from a driven shaft and removed as a unit from the weather-proof housing.

Still a further object of the invention is to provide a circuit disconnect apparatus for three phase electric power lines that can be easily changed from manual to power operation or vice versa.

THE DRAWINGS

DETAILED DESCRIPTION OF THE INVENTION

Figure 1:
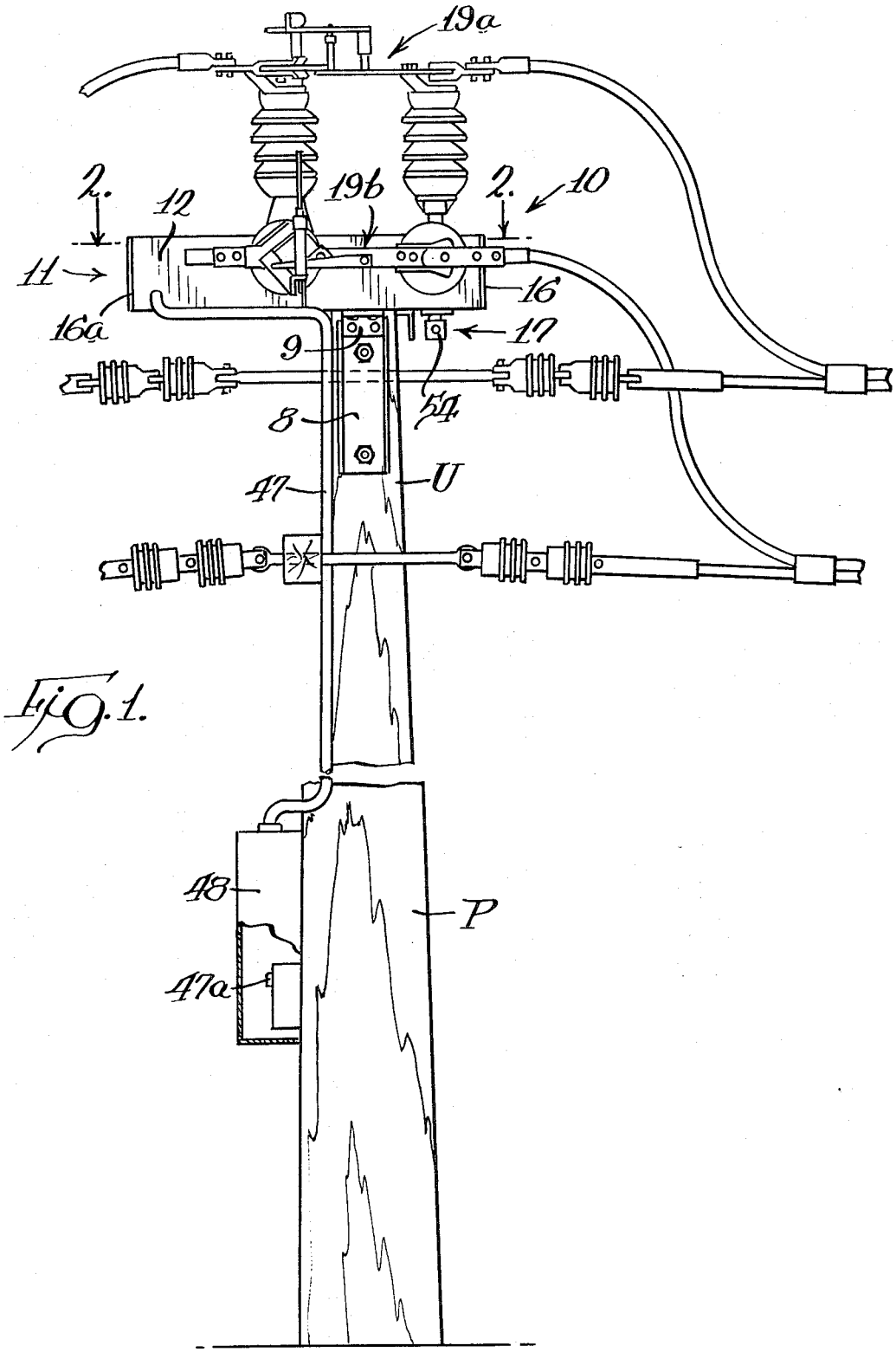
FIG. 1 is a side elevational view of a power driven group operated circuit disconnect apparatus embodying the invention, with a control box shown partly in section.

Referring to the drawings in detail, and referring first to FIG. 1, a pole, indicated generally at P, has an upper end U to which a mounting bracket 8 is attached; and bolted to the upper end of the bracket 8 is an angle bracket 9 to which is secured the circuit disconnect apparatus of the present invention, which is indicated generally at 10.

The apparatus 10 includes a base, indicated generally at 11, which consists of a box-like housing having side walls 12 and 13, a bottom wall 14 and a top wall 15. The base 11 has removable closures 16 and **16*a*** at its ends.

Extending through the base 11 is an upright shaft means, indicated generally at 17, and transverse shaft means, indicated generally at 18. A first disconnect switch, indicated generally at **19*a*, surmounts the base 11 and is operated by rotation of the upright shaft means 17; while a second disconnect switch 19*b* is mounted upon the base side wall 12, and a third disconnect switch (not shown) is mounted on the sidewall 13. Both of said last named disconnect switches are operated by rotation of the transverse shaft means 18**.

A mechanical connection, indicated generally at 20, interconnects the upright shaft means 17 and the transverse shaft means 18 so that the two shaft means rotate simultaneously and equally.

The shaft means 17 and 18 and the mechanical connection 20 are fully described in U.S. Pat. No. 4,095,061; so no detailed description is given here.

Figure 2:
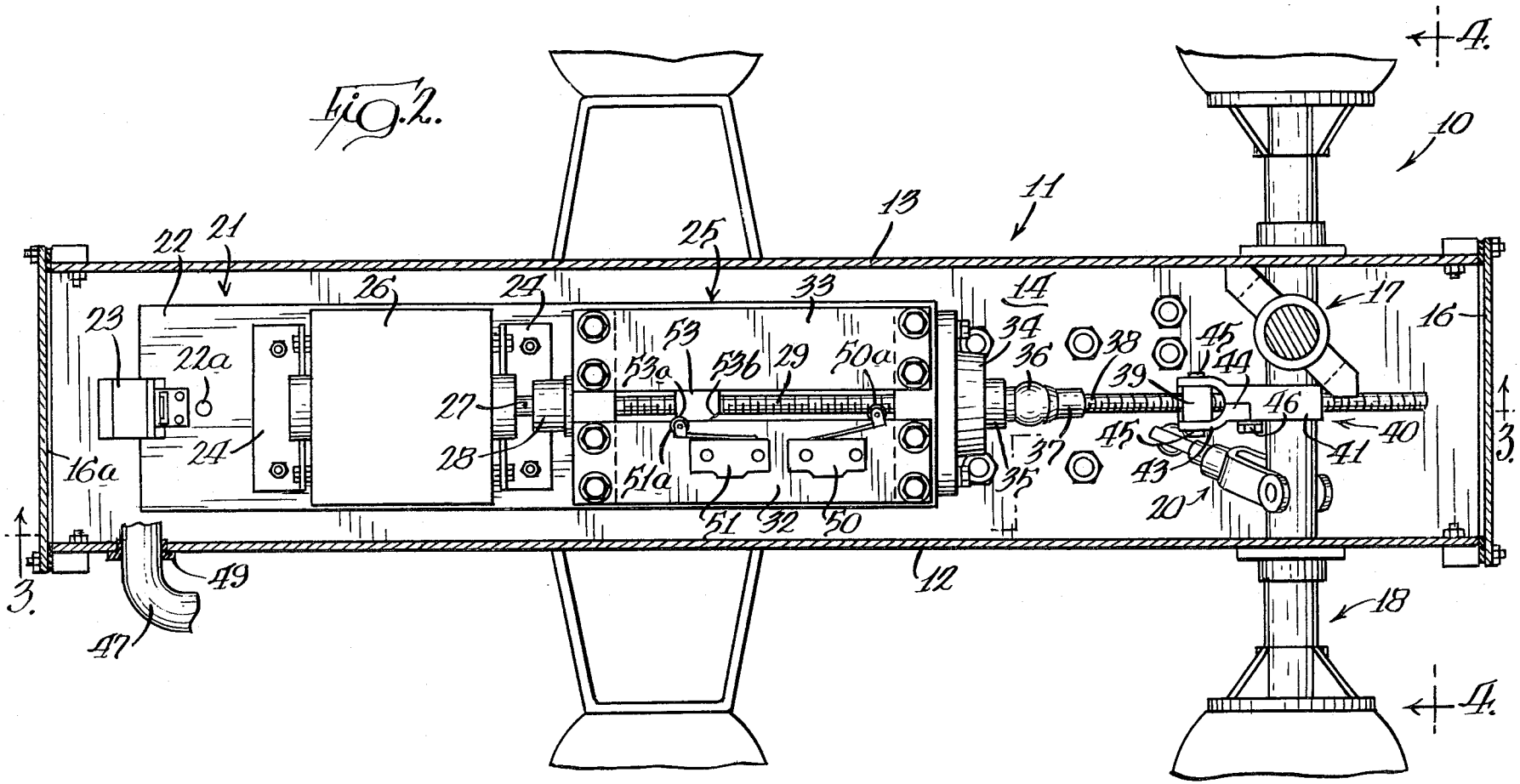
FIG. 2 is a fragmentary longitudinal horizontal sectional view on an enlarged scale take substantially as indicated along the line 2—2 of FIG. 1.
Figure 3:
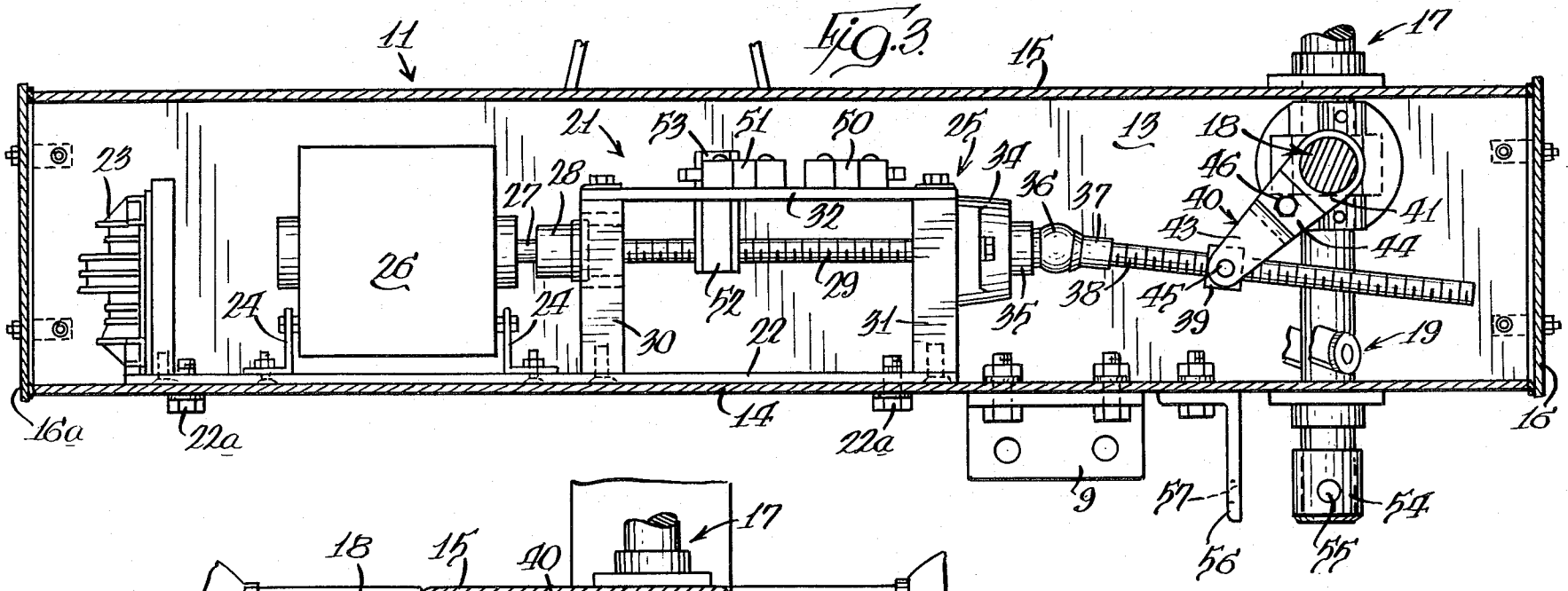
FIG. 3 is a fragmentary longitudinal vertical sectional view with parts broken away, taken substantially as indicated along the line 3—3 of FIG. 2.

The power drive for the circuit disconnect apparatus consists of a subassembly, indicated generally at 21, which is best seen in FIGS. 2 and 3. A base plate 22 is secured to the housing bottom wall 14 by a pair of hex-headed machine screws **22*a* which screw into threaded holes in the base plate; and mounted upon the base plate is a terminal block 23; motor mounting brackets 24; and a bridge frame, indicated generally at 25**.

The mounting brackets 24 support a fractional horsepower A.C. motor 26 which may, for example, be 0.5 h.p. A motor shaft 27 is provided with a flexible coupling 28; and a threaded shaft 29 has one end connected to the flexible coupling 28.

The bridge frame 25 consists of an upright support block 30 and an upright bearing block 31 which are surmounted by parallel rails 32 and 33. An opening in the support block 30 accommodates the outer end portion of the flexible coupling 28; and the bearing block 31 serves as a mounting for a flanged bearing 34 which rotatably receives a coupling 35 which carries the outer end of the threaded shaft 29 and is a part of an assembly including the threaded shaft 29, a universal joint 36, and a coupling 37 to which the inner end of a power screw 38 is fixedly secured.

Figure 4:
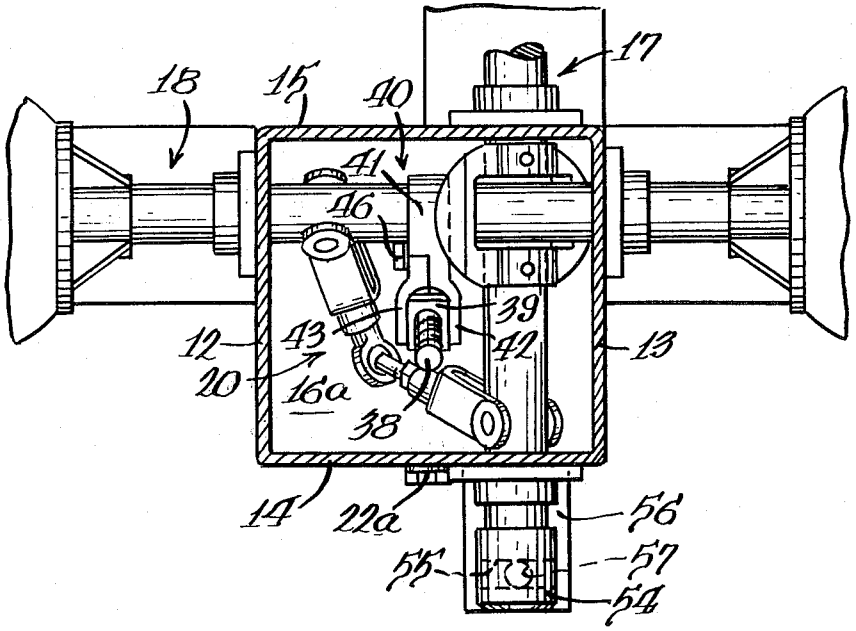
FIG. 4 is a fragmentary transverse sectional view taken substantially as indicated along the line 4—4 of FIG. 2 with parts omitted for clarity.

As best seen in FIGS. 3 and 4, the power drive is operatively connected to the transverse shaft means 18 by a threaded drive nut 39 which is adapted to travel along the power screw 38, and a crank yoke, indicated generally at 40. The crank yoke includes a collar member 41 which is fixedly secured to the transverse shaft means 18 and has an offset crank arm 42, and a yoke arm 43 which includes a mounting portion 44 and an offset yoke portion, so integral trunnions 45 on the threaded drive nut 39 may be received in holes in the offset crank arm 42 and the offset yoke portion 43, and the crank assembly 40 can be disconnected from the drive nut 39 by removing a machine screw 46 by which the offset crank arm and the offset yoke arm are secured together.

The power screw 38 and the threaded drive nut 39 provide a driving connection between a power unit (motor 26) and the crank arm 42. In that driving connection the drive nut 39, with its trunnions 45 received in the holes in the crank arm 42 and the yoke portion 43, serves as a member which is fixedly pivotally connected to the outer end of the crank arm, and the threaded connection between the drive nut 39 and the power screw 38 provides means for linearly reciprocating said member. Further, the universal joint 36 serves as mounting means which permits displacement of the linear reciprocating means 38-39 relative to the axis of rotation of the transverse shaft means 18 and in the plane of the crank arm 42, to compensate for the difference between the linear reciprocation of the drive nut 39 and the arcuate movement of the outer end of the crank arm 42.

From the foregoing description, it is apparent that the entire power subassembly 21 may be removed from the housing 11 by removing the end closures 16 and **16*a*, removing the machine screw 46 and disengaging the trunnions 45 from the crank member 40, and removing the machine screws 22*a* that secure the subassembly to the housing bottom wall 14. It is also necessary, of course, to disconnect from the terminal block 23 an electrical cable 47 which extends through a hole in the housing side wall 12 and has a lower end connected to a control box 48 which is near ground level on the post P. A flanged rubber sealing collar 49 snugly grips the cable 47 and makes a tight sealing fit in the hole in the housing side wall 12**.

Mounted upon the bridge frame rail 32 are limit switches 50 and 51 which are seen in FIG. 2 to have respective actuator arm follower rollers **50*a* and 51*a* extending into the space above an opening between the rails 32 and 33 where they may be contacted by a threaded traveler 52 which is mounted upon the threaded shaft 29 and has an upper actuating portion 53 above the horizontal plane of the rails 32 and 33 where it has first and second actuating cam faces 53*a* and 53*b* which may contact the limit switch follower rollers 50*a* and 51*a*, respectively, as the traveler 52 moves back and forth responsive to rotation of the threaded shaft 29**.

In the drawings the traveler 52 is seen to be in contact with the follower roller **51*a* of the limit switch 51, which is therefore a switch that stops operation of the motor 26 when the disconnect switches are fully closed. The limit switch 50, therefore, serves to stop operation of the motor 26** when the disconnect switches reach their fully open positions.

In order that the present apparatus may be readily converted from manual to power operation, the lower end of the shaft means 17 has a removable cap 54 (FIGS. 3 and 4) which has holes 55 in its side wall that align with a bore in the lower end portion of the shaft means 17. When the cap 54 is removed a manual operating crank shaft may be operatively connected to the lower end of the shaft means 17 by a pin extending through the bore as taught in U.S. Pat. No. 4,095,061.

A safety stop bracket 56 alongside the cap 54 has a hole 57 which is in the same horizontal plane as the holes 55 and the aligned bore of the shaft means 17. The disconnect switches, of course rotate 90° from the enclosed position of FIG. 1 to a fully open position; so when the switches are open the bore in the shaft 17 and the aligned holes 55 in the cap 54 are also aligned with the hole 57, permitting insertion of a retaining pin through the bore and through the holes 55 and 57 to mechanically lock the disconnect switches in their open positions for the added safety of anybody working on the line.

The control box 48 contains a switch **47*a* for starting the motor 26; and in case the circuit disconnect apparatus is also intended for control from a central point, as in increasingly the case in major power distribution systems, the control box 48** must also, of course, have a terminal to the central control system with an interlock which permits a person working on the line to disable the central control hook-up to eliminate the possibility that the switch may be closed from the switching center while he is working on the line.

When the power drive has an A.C. motor as here described, it is easily driven either to open or close the disconnect switches by a 110 volt energizing circuit from the power line. On the other hand, where a direct current motor is used the control box must also contain a transformer and storage batteries to furnish a direct current source for energizing the motor, which may be as small as 0.25 h.p. There is some advantage in direct current operation in the event of a power failure, because current batteries, which are kept constantly charged, can reliably open and close the switches as much as 25 or 30 times, even if the power is off. However, the A.C. operating system is, of course, simpler and much less expensive.

The foregoing detailed description is given for clearness of understanding only, and no unnecessary limitations should be understood therefrom, as modifications will be obvious to those skilled in the art.

I claim:

1. In an electric circuit disconnect apparatus which has a base rotatable shaft means on said base, and a disconnect switch blade moved between closed and open positions by rotation of said shaft means, a power drive for rotating said shaft means comprising, in combination:

a power unit which has a reversible rotary shaft;

a crank arm on said shaft means;

a driving connection between said reversible rotary shaft and said crank arm, said driving connection including, a drive screw rotated by said reversible rotary shaft, a member pivotally connected to the crank arm, said member having a threaded mounting on said drive screw so that it is linearly reciprocated by rotation of the drive screw, and connecting means between said reversible rotary shaft and said drive screw which permits the latter to pivot in the plane of movement of the crank arm so as to compensate for the difference between the linear reciprocation of said pivotally connected member and the arcuate movement of the crank arm;

power control means for starting said power unit;

and additional power control means for automatically stopping said power unit effectively simultaneously with arrival of the switch blade at fully closed position and at fully open position.

2. The combination of claim 1 in which the additional power control means includes spaced power control devices, actuating means for said devices, and means for reciprocating said actuating means in timed relationship to the reciprocation of the pivotally connected member.

3. The combination of claim 2 in which the actuating means for the power control devices comprises a threaded traveler, and the means for reciprocating the actuating means comprises a threaded shaft rotated by the reversible rotary shaft and operatively engaging said threaded traveler.

4. The combination of claim 1 in which the base is a box-like housing, the axially rotatable shaft means extends through said housing, and the following elements of the combination are enclosed within the housing:

(1) the power unit, (2) the crank arm, (3) the driving connection, (4) the additional power control means, in which an electric terminal block is also mounted in the housing for connection between an energizing circuit and the power unit and between said additional power control means and said energizing circuit, and in which the power control means for starting the power unit is in said energizing circuit remote from said housing.

5. The combination of claim 4 in which the housing has two open ends, removable end walls close said open ends, the driving connection has a manually detachable part immediately inside one of said open ends, and a subassembly is removable through the other of said open ends, said subassembly including:

(1) the power unit, (2) the driving connection other than said manually detachable part, (3) the additional power control means, (4) the electric terminal block.

6. The combination of claim 1 in which the connecting means is a universal joint.

7. In a group operated electric circuit disconnect apparatus for a plurality of overhead electric power distribution lines carried on poles of a type which includes a box-like housing adapted to be mounted adjacent the top of a pole, said housing having opposite ends which are open, a removable closure for each of said open ends, a first disconnect switch surmounting the housing, second and third disconnect switches mounted at opposite sides of the housing, an upright shaft means journalled on and extending through said housing, said upright shaft means being operatively connected to said first switch so that axial rotation of the upright shaft means opens and closes the first switch, transverse shaft means journalled on and extending through said housing, said transverse shaft means being operatively connected to said second and third switches so that axial rotation of said transverse shaft means opens and closes said second and third switches, and a mechanical connection between said upright shaft means and said transverse shaft means within said housing so that axial rotation of one of said shaft means causes axial rotation of the other of said shaft means, the improvement comprising, in combination:

a subassembly in the housing which is removable through one of said open ends, said subassembly including:

(1) a reversible electric motor having a rotatable shaft, (2) a first part of a driving connection between said electric motor shaft and one of said shaft means for axially rotating said one of said shaft means from said rotatable shaft to selectively open or close the three disconnect switches, (3) an electric terminal block for connection between an energizing circuit and said electric motor, (4) power control means for automatically stopping the electric motor simultaneously with arrival of the disconnect switches at fully closed position and at fully open position;

a second part of said driving connection which is immediately adjacent the other of said open ends and manually detachable from said first part;

and a motor start switch in said energizing circuit remote from said housing.

8. The combination of claim 7 in which the first part of the driving connection comprises a universal joint, means fixedly connecting said universal joint to the motor shaft, a drive screw fixedly connected to said universal joint, a drive nut on said screw, and said manually detachable second part operatively connects said drive nut to said one of said shaft means.

9. The combination of claim 8 in which the means fixedly connecting the universal joint to the motor shaft includes a threaded shaft, the power control means comprises first and second normally closed limit switches mounted immediately adjacent said threaded shaft, and a threaded traveler carried on said threaded shaft actuates said limit switches.

10. The combination of claim 7 in which the first part of the driving connection comprises a drive screw operatively connected to the shaft of the electric motor, a drive nut on said screw, and the manually detachable second part of said driving connection is between said drive nut and said one of the shaft means.

11. The combination of claim 10 in which the drive nut is provided with trunnions, the manually detachable second part of the driving connection comprises a crank arm on said one of the shaft means which pivotally receives said trunnions, and means for accommodating the travel of the drive nut relative to said one of said shaft means and the swing of the crank arm relative to the drive nut.

12. The combination of claim 11 in which said means for accommodating comprises a universal joint, means fixedly connecting the universal joint to the motor shaft, and means fixedly securing one end of the drive screw to the universal joint, the other end of the drive screw being supported only by the drive nut and the operative connection between the drive nut and said one of the shaft means.

13. In a group operated electrical circuit disconnect apparatus for a plurality of overhead electric power distribution lines carried on poles of a type which includes a base adapted to be mounted adjacent the top of a pole, a first disconnect switch surmounting the base, second and third disconnect switches mounted at opposite sides of the base, an upright shaft means journalled on said base, said upright shaft means being operatively connected to said first switch so that axial rotation of the shaft means opens and closes the first switch, transverse shaft means journalled on said base and operatively connected to said second and third switches so that axial rotation of said transverse shaft means opens and closes said second and third switches, and a mechanical connection between said upright shaft means and said transverse shaft means so that axial rotation of one of said shaft means causes axial rotation of the other of said shaft means, the improvement comprising, in combination:

a power unit which has a reversible rotary shaft;

a crank arm on one of said shaft means;

a driving connection between said reversible rotary shaft and said crank arm, said driving connection including, a drive screw rotated by said reversible rotary shaft, a member pivotally connected to the crank arm, said member having a threaded mounting on said drive screw so that it is linearly reciprocated by rotation of the drive screw, and connecting means between said reversible rotary shaft and said drive screw which permits the latter to pivot in the plane of movement of the crank arm so as to compensate for the difference between the linear reciprocation of said pivotally connected member and the arcuate movement of the crank arm;

power control means for starting said power unit;

and additional power control means for automatically stopping said power unit effectively simultaneously with arrival of the switch blade at fully closed position and at fully open position.

14. The combination of claim 13 in which the base is a box-like housing, the upright and transverse shaft means extend through the housing, and the following elements of the combination are enclosed within the housing;

(1) the mechanical connection between the shaft means, (2) the power unit, (3) the crank arm, (4) the driving connection, (5) the additional power control means, in which an electric terminal block is also mounted in the housing for connection between an energizing circuit and the power unit and between said additional power control means and said energizing circuit, and in which the power control means for starting the power unit is in said energizing circuit remote from said housing.

15. The combination of claim 14 in which the housing has two open ends, removable end walls close said open ends, the driving connection has a manually detachable part immediately inside one of said open ends, and a subassembly is removable through the other of said open ends, said subassembly including:

(1) the power unit, (2) the driving connection other than said manually detachable part;

(3) the additional power control means, (4) the electric terminal block.

16. The combination of claim 13 in which the connecting means is a universal joint.

17. The combination of claim 13 in which the additional power control means includes spaced power control devices, actuating means for said devices, and means for reciprocating said actuating means in timed relationship to the reciprocation of the pivotally connected member.

18. The combination of claim 17 in which the actuating means for the power control devices comprises a threaded traveler, and the means for reciprocating the actuating means comprises a threaded shaft rotated by the reversible rotary shaft and operatively engaging said threaded traveler.

19. In an electric circuit disconnect apparatus of a type which includes a box-like housing having opposite ends which are open, a removable closure for each of said open ends, an axially rotatable shaft means journalled on and extending through said housing, and a disconnect switch blade moved between closed and open positions by rotation of said shaft means, the improvement comprising, in combination:

a subassembly in the housing which is removable through one of said open ends, said subassembly including:

(1) a power unit, (2) a first part of a driving connection between said power unit and said shaft means for axially rotating said shaft means from said power unit to selectively open or close said disconnect switch blade, (3) power control means for automatically stopping the power unit effectively simultaneously with arrival of the disconnect switch blade at fully closed position and at fully open position, (4) an electric terminal block for connection between an energizing circuit and said power control means;

a second part of said driving connection which is immediately adjacent the other of said open ends and manually detachable from said first part;

and a power unit start switch in said energizing circuit remote from said housing.

20. The combination of claim 19 which includes a crank arm on said shaft means which has an outer end that moves arcuately with axial rotation of the shaft means, the manually detachable second part of the driving connection includes one element pivotally connected adjacent said outer end of said crank arm, a second element, means manually detachably connecting said first element to said second element, and an operative connection between said second element and the power unit.

21. The combination of claim 20 in which the first element is fixedly pivotally connected to the crank arm, the operative connection between the second element and the power unit imparts linear reciprocation to said second element, and there is means remote from the crank arm to accommodate said linear reciprocation and said arcuate movement of the crank arm.

22. The combination of claim 21 in which the power unit is a reversible electric motor having a rotatable shaft.

23. The combination of claim 22 in which the first part of the driving connection comprises a universal joint which provides said means remote from the crank arm, means fixedly connecting said universal joint to the motor shaft, a drive screw fixedly connected to said universal joint, and a drive nut on said screw which is said second element of said manually detachable second part of the driving connection.

24. The combination of claim 23 in which the means fixedly connecting the universal joint to the motor shaft includes a threaded shaft, the power control means comprises first and second normally closed limit switches mounted immediately adjacent said threaded shaft, and a threaded traveler carried on said threaded shaft actuates said limit switches.

25. The combination of claim 22 in which the first part of the driving connection comprises a drive screw operatively connected to the shaft of the electric motor, a drive nut on said screw which is said second element of said manually detachable second part of the driving connection.

26. The combination of claim 25 in which said means to accommodate comprises a universal joint, means fixedly connecting the universal joint to the motor shaft, and means fixedly securing one end of the drive screw to the universal joint, the other end of the drive screw to the universal joint, the other end of the drive screw being supported only by the drive nut and the means detachably connecting the drive nut to the first element.

27. In a group operated electric circuit disconnect apparatus for a plurality of overhead electric power distribution lines carried on poles of a type which includes a box-like housing adapted to be mounted adjacent the top of a pole, said housing having opposite ends which are open, a removable closure for each of said open ends, a first disconnect switch surmounting the housing, second and third disconnect switches mounted at opposite sides of the housing, an upright shaft means journalled on an extending through said housing, said upright shaft means being operatively connected to said first switch so that the axial rotation of the upright shaft means opens and closes the first switch, transverse shaft means journalled on and extending through said housing, said transverse shaft means being operatively connected to said second and third switches so that axial rotation of said transverse shaft means opens and closes said second and third switches, and a mechanical connection between said upright shaft means and said transverse shaft means within said housing so that axial rotation of one of said shaft means causes axial rotation of the other of said shaft means, the improvement comprising, in combination:

a subassembly in the housing which is removable through one of said open ends, said subassembly including:

(1) a power unit, (2) a first part of a driving connection between said power unit and one of said shaft means for axially rotating said one of said shaft means from said power unit to selectively open or close the three disconnect switches, (3) power control means for automatically stopping the power unit simultaneously with arrival of the disconnect switches at fully closed position and at fully open position;

(4) an electric terminal block for connection between an energizing circuit and said power control means;

a second part of said driving connection which is immediately adjacent the other of said open ends and manually detachable from said first part;

and a power unit start switch in said energizing circuit remote from said housing.

* * * * *